US008960288B2

(12) United States Patent
Sampson

(10) Patent No.: US 8,960,288 B2
(45) Date of Patent: Feb. 24, 2015

(54) SELECT FIRE STACKABLE GUN SYSTEM

(75) Inventor: Tim W. Sampson, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 553 days.

(21) Appl. No.: 13/116,730

(22) Filed: May 26, 2011

(65) Prior Publication Data

US 2012/0298361 A1 Nov. 29, 2012

(51) Int. Cl.

| | |
|---|---|
| ***E21B 43/116*** | (2006.01) |
| ***E21B 43/119*** | (2006.01) |
| ***E21B 43/112*** | (2006.01) |
| ***E21B 23/01*** | (2006.01) |

(52) U.S. Cl.

CPC ..... *E21B 43/112* (2013.01); *E21B 23/01* (2013.01)

USPC ..... 166/297; 166/55; 166/382; 166/378; 166/242.6

(58) Field of Classification Search

USPC ..... 166/297, 55, 55.1, 55.2, 381, 382, 384, 166/378, 242.6, 243

See application file for complete search history.

(56) References Cited

U.S. PATENT DOCUMENTS

| | | | | |
|---|---|---|---|---|
| 2,488,803 | A | 11/1949 | Charrin | |
| 2,494,256 | A | 1/1950 | Muskat | |
| 2,655,619 | A | 10/1953 | Neal | |
| 3,202,227 | A | 8/1965 | Ezran | |
| 3,773,120 | A * | 11/1973 | Stroud et al. | 175/4.55 |
| 3,860,865 | A | 1/1975 | Stroud et al. | |
| 4,454,814 | A | 6/1984 | Henry et al. | |
| 4,457,383 | A | 7/1984 | Boop | |
| 4,527,636 | A | 7/1985 | Bordon | |
| 4,656,944 | A | 4/1987 | Gonzalez | |
| 4,895,218 | A | 1/1990 | Chen et al. | |
| 5,159,146 | A | 10/1992 | Carisella | |
| 5,287,924 | A | 2/1994 | Burleson et al. | |
| 5,366,014 | A | 11/1994 | George | |
| 5,810,088 | A * | 9/1998 | Lamirand et al. | 166/377 |
| 5,992,523 | A * | 11/1999 | Burleson et al. | 166/297 |
| 6,059,042 | A * | 5/2000 | Huber et al. | 166/377 |
| 6,098,716 | A * | 8/2000 | Hromas et al. | 166/377 |
| 6,298,915 | B1 * | 10/2001 | George | 166/255.2 |
| 6,386,288 | B1 | 5/2002 | Snider et al. | |
| 6,491,098 | B1 | 12/2002 | Dallas | |
| 6,591,731 | B2 | 7/2003 | Goldstein | |

(Continued)

FOREIGN PATENT DOCUMENTS

| | | | |
|---|---|---|---|
| EP | 482969 | B1 | 8/1996 |
| EP | 752514 | B1 | 9/2002 |
| WO | WO2007082225 | A2 | 7/2007 |

OTHER PUBLICATIONS

Schlumberger Oilfield Glossary entry for "completion fluid", accessed Jun. 27, 2013 via www.glossary.oilfield.slb.com.*

(Continued)

*Primary Examiner* — Blake Michener

(74) *Attorney, Agent, or Firm* — Bracewell & Giuliani LLP

(57) ABSTRACT

A system and method of perforating by stacking a perforating string within a wellbore, then deploying the perforating string to a designated depth for detonating shaped charges in the perforating string. The string can be formed by anchoring a single perforating gun in the wellbore, then landing subsequent guns on one another atop the anchored gun. Wet connects on the ends of the perforating guns enable mechanical engagement of each adjacent gun as well as signal communication through the connections.

17 Claims, 4 Drawing Sheets

(56) References Cited

U.S. PATENT DOCUMENTS

| | | | | |
|---|---|---|---|---|
| 6,658,981 | B2 * | 12/2003 | Rochen et al. | 89/1.15 |
| 6,672,405 | B2 | 1/2004 | Tolman et al. | |
| 6,712,146 | B2 * | 3/2004 | Estep et al. | 166/377 |
| 6,719,061 | B2 * | 4/2004 | Muller et al. | 166/373 |
| 6,966,378 | B2 * | 11/2005 | Hromas et al. | 166/298 |
| 7,059,407 | B2 | 6/2006 | Tolman et al. | |
| 7,066,261 | B2 | 6/2006 | Vicente et al. | |
| 7,325,616 | B2 * | 2/2008 | Lopez de Cardenas et al. | 166/313 |
| 7,461,580 | B2 | 12/2008 | Bell et al. | |
| 7,762,172 | B2 | 7/2010 | Li et al. | |
| 7,861,785 | B2 * | 1/2011 | Frazier et al. | 166/299 |
| 2002/0053434 | A1 * | 5/2002 | Chen et al. | 166/297 |
| 2002/0100360 | A1 | 8/2002 | Rochen et al. | |
| 2002/0185276 | A1 * | 12/2002 | Muller et al. | 166/297 |
| 2003/0196806 | A1 * | 10/2003 | Hromas et al. | 166/297 |
| 2009/0223400 | A1 | 9/2009 | Hill et al. | |
| 2011/0024116 | A1 | 2/2011 | McCann et al. | |

OTHER PUBLICATIONS

Dictionary definition of "affix", accessed Dec. 19, 2013 via thefreedictionary.com.*

Schlumberger Oilfield Glossary entry for "wellhead", accessed Dec. 19, 2013 via www.glossary.oilfield.slb.com.*

Article, E-BOMB, Popular Mechanics, Sep. 2001.

Int'l Search Report and Written Opinion (PCT/US2012/038974), dated Dec. 10, 2012.

* cited by examiner 3
7
9
1
2
11
5
4
13
10
8
12
6

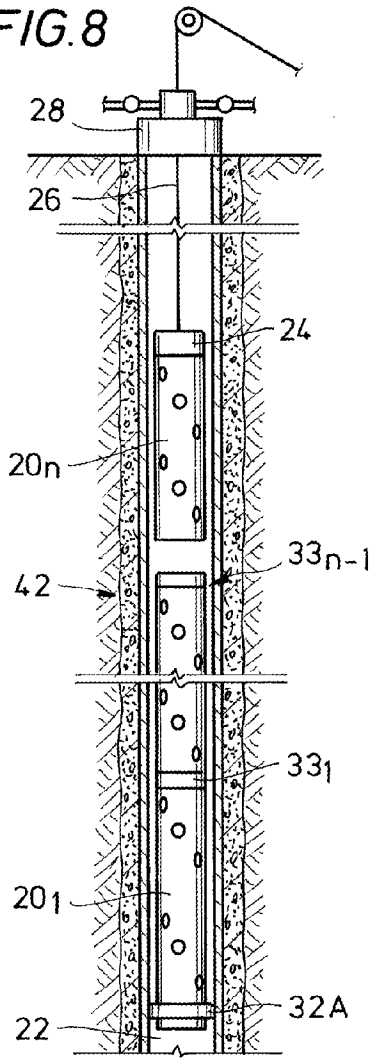
FIG. 8
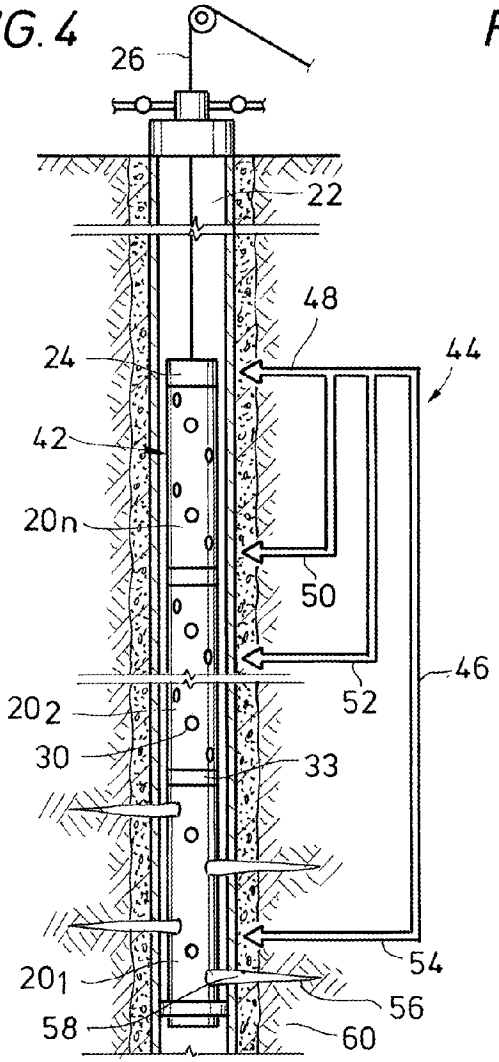
FIG. 4
FIG. 3
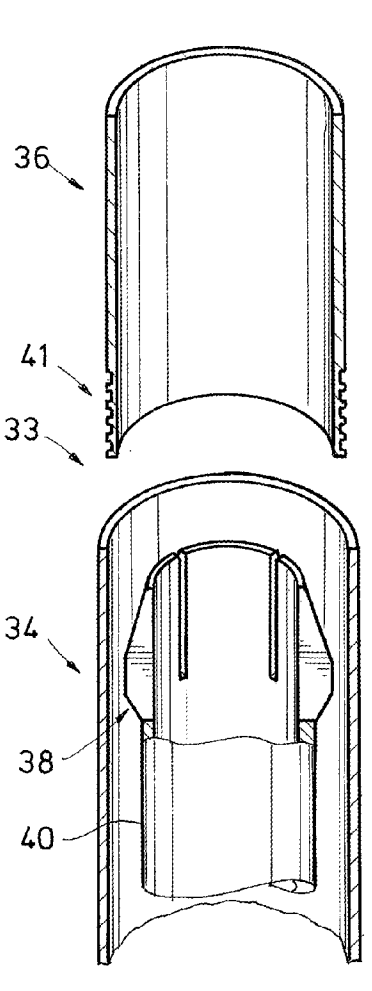

$20_{i+1}$
36A
33A
64
34A
30
$20_i$
70
66
68
62
65
36B
84
80
33B
72
76
34B
86
82
88
90
74
78
36C
97
33C
92
78
86
100
98
94
96
76
34C

SELECT FIRE STACKABLE GUN SYSTEM

BACKGROUND

1. Field of Invention

The invention relates generally to the field of oil and gas production. More specifically, the present invention relates to a system and method for stacking perforating guns to form a perforating string.

2. Description of Prior Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore.

Perforating systems typically comprise one or more perforating guns strung together, these strings of guns can sometimes surpass a thousand feet of perforating length. In FIG. 1 a prior art perforating system 11 is shown having a perforating gun string 4 with perforating guns 6. The gun string 4 is shown disposed within a wellbore 1 on a wireline 5. The perforating guns 6 in the gun string 4 are usually coupled together by connector subs 13. A service truck 7 on the surface 9 generally accompanies perforating systems 11 for handling the upper end of the wireline 5. The wireline 5 typically is used for raising and lowering the gun string 4, as well as a communication means and control signal path between the truck 7 and the perforating gun 6. The wireline 5 is generally threaded through pulleys 3 supported above the wellbore 1. As is known, derricks, slips and other similar systems may be used in lieu of a surface truck for inserting and retrieving the perforating system into and from a wellbore. Moreover, perforating systems are also disposed into a wellbore via tubing, drill pipe, slick line, and/or coiled tubing.

Included with the perforating gun 6 are shaped charges 8 that typically include a housing, a liner, and a quantity of high explosive inserted between the liner and the housing. When the high explosive is detonated, the force of the detonation collapses the liner and ejects it from one end of the charge 8 at very high velocity in a pattern called a "jet" 12. The jet 12 perforates the casing and the cement and creates a perforation 10 that extends into the surrounding formation 2.

Typically the gun string 4 is inserted within a lubricator that is then mounted on a wellhead assembly for deployment into a wellbore. The lubricator provides a pressure seal around the string 4 so the gun string 4 can be pressure equalized with the usually higher pressure wellbore prior to being deployed therein. In some instances space constraints at the well site may limit the height of the lubricator thereby in turn limiting the length of the gun string 4.

SUMMARY OF INVENTION

Disclosed herein is an example method and apparatus for perforating a wellbore. In one example method a string of perforating guns is formed by inserting a perforating gun into a wellbore and then anchoring the perforating gun to a wall of the wellbore. Another perforating gun is then inserted into the wellbore and lowered onto the anchored perforated gun. These guns are then coupling to one another to form a string of perforating guns. Alternatively, the anchor on the perforating gun is removed and the string is lowered deeper into the wellbore. Optionally, a plurality of perforating guns is added into the wellbore that are coupled to each adjacent perforating gun. In an example embodiment, each perforating gun is lowered via wireline into the wellbore. Optionally, wet connections are provided on each of the perforating guns, so that when the perforating guns are disposed in liquid and coupled to one another, the perforating guns are in electrical communication through the wet connectors. Optionally, an anchor can be added onto the perforating gun, so that by deploying the anchor from the perforating gun into contact with the wall of the wellbore the perforating gun is anchored in the wellbore. Further, the method can include resetting the anchor, decoupling the another perforating gun from the perforating gun, and removing the another perforating gun and the perforating gun from the wellbore.

An alternate method of perforating a wellbore is provided herein that includes anchoring a perforating gun to a wall of the wellbore and coupling another perforating gun to the perforating gun anchored to the wellbore wall to form a perforating gun string. The perforating gun is released from the wall of the wellbore and the perforating string is lowered to a designated depth within the wellbore where the wellbore is perforated by detonating shaped charges disposed within the perforating string. Communication may occur between the perforating gun and the another perforating gun. As the shaped charges in either of the perforating gun or the another perforating gun may be detonated at different times, the method may further include moving the perforating string to a depth different from the designated depth of the initial step of detonation, and detonating shaped charges not already detonated. Optionally, a plurality of additional perforating guns may be provided, where the additional perforating guns are coupled to the upper end of the another perforating gun. The perforating string can be re-anchored in the wellbore, and each of the guns selectively decoupled. A connector for connecting each adjacent gun may optionally be provided, wherein each connector is assigned an address, so that by directing a signal to the address each of the guns are selectively decoupled.

Also described herein is a perforating system, that in one embodiment is made up of a lower perforating gun, a selectively deployable anchoring device on the lower perforating gun, an upper connector on an upper end of the lower perforating gun, and a contact on an end of the upper connector distal from the lower perforating gun. The contact is in signal communication with the lower perforating gun. Also included is an upper perforating gun with a lower connector on its lower end, where the lower connector automatically connects to the upper connector when the lower connector lands on the upper connector. In an example embodiment, a receptacle is on an end of the lower connector distal from the upper perforating gun. An opening in the receptacle is in signal communication with the upper perforating gun, so that when the upper and lower perforating guns are coupled the upper and lower connector are mated such that the contact inserts into the opening and the upper and lower perforating guns are in signal communication. In an example embodiment, a selectively releasable coupling is provided that is disposed in at least one of the lower connector or lower connector. In an example embodiment, a communications module is provided in the upper perforating gun in signal communication with a communications module in the lower perforating gun. In an example embodiment, signal communication between the communications modules in the upper and lower perforating guns is routed through the connectors.

BRIEF DESCRIPTION OF DRAWINGS

Some of the features and benefits of the present invention having been stated, others will become apparent as the description proceeds when taken in conjunction with the accompanying drawings, in which:

FIG. 3 is a perspective side sectional view of an example embodiment of a connector for perforating guns in accordance with the present invention.

FIG. 4 is a side partial sectional view of a method of perforating a wellbore in accordance with the present invention.

FIG. 8 is a side partial sectional view of an example of removing a perforating string from a wellbore in accordance with the present invention.

Figure 1:
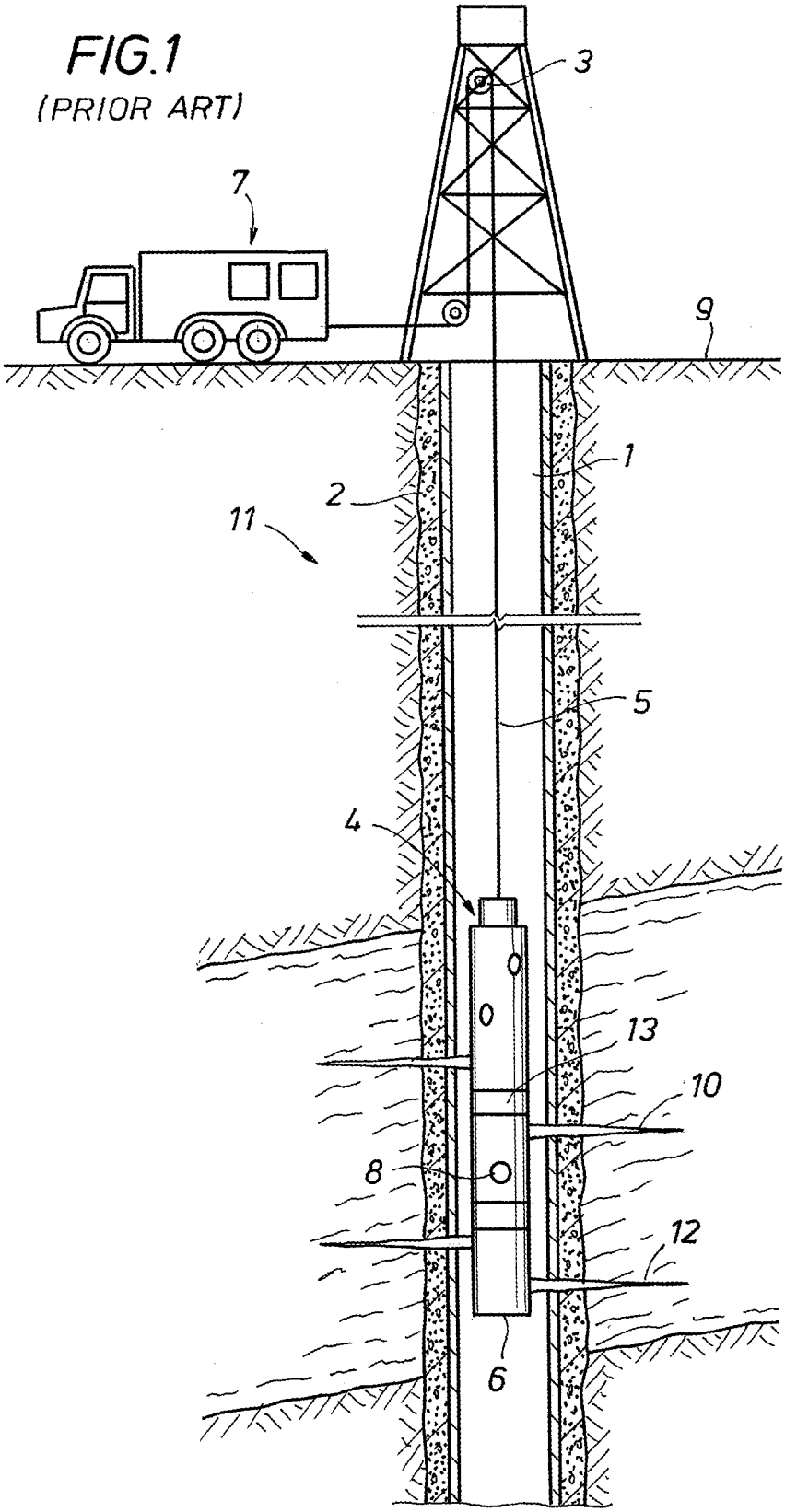
FIG.1 (PRIOR ART)
FIG. 1 is a side partial sectional view of a prior art perforating system used for perforating a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

Figure 2C:
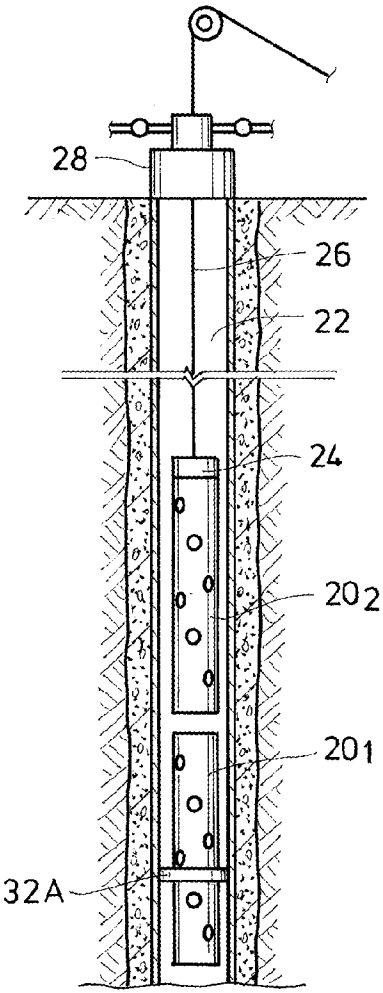
FIGS. 2A through 2C are side partial sectional views of a perforating string being stacked together in a wellbore in accordance with the present invention.
Figure 2B:
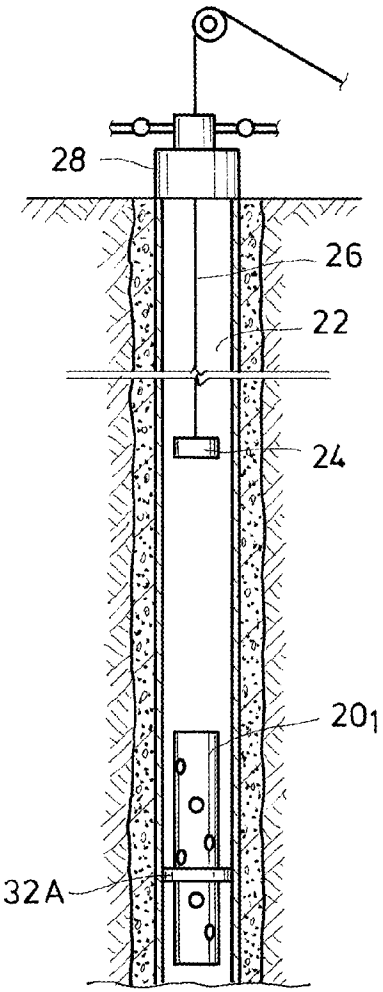
Figure 2A:
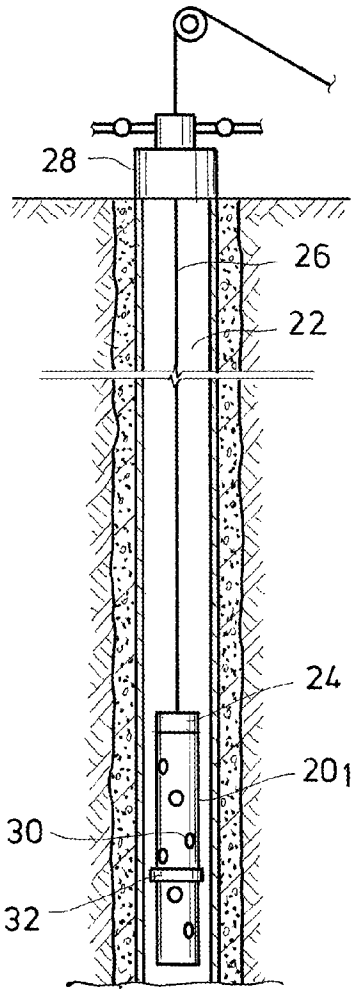

FIGS. 2A through 2C illustrate an example method of forming a perforating gun string within a wellbore. More specifically and with reference to FIG. 2A, a perforating gun 201 is shown being lowered into a wellbore 22 by attachment on its upper end to a cablehead 24. A wireline 26 mounts on a side of the cablehead 24 opposite a side where it couples to the upper end of the perforating gun 201. The wireline 26, which inserts into the wellbore 22 through a wellhead assembly 28, may be spooled from a service truck (not shown), derrick (not shown), or other deployment means disposed on the surface. Shaped charges 30 are provided with the perforating gun 201 and shown positioned to direct a jet radially outward from the perforating 201. Also included with the perforating gun 201 of FIG. 2A is an anchor 32 in a retracted mode and circumscribing the outer surface of the perforating gun 201. In the example embodiment of FIG. 2B, the anchor 32A is deployed and extends across the annulus between the perforating gun 201 and an inner wall of the wellbore 22. The anchor 32A exerts opposing forces against the perforating gun 201 in the wall of the wellbore 22 thereby suspending the perforating gun 201 at a designated location within the wellbore 22. Once supported within the wellbore 22 by the anchor 32A, the cablehead 24 can be released from the perforating gun 201 and drawn up the wellbore 22 for optional attachment of a subsequent perforating gun 202 (FIG. 2C) and lowered on the wireline 26 and onto the anchored perforating gun 201. This process is repeated until a string of perforating guns is formed. When a string of designated or desired length is formed, the anchor 32A can be released thereby allowing the string to be deployed to a depth or depths for perforating operations.

Attachment between perforating guns may occur upon landing a perforating gun on an adjacent lower perforating gun. Shown in a perspective and side section view in FIG. 3 is one example of a connector 33 for coupling adjacent guns. In the example of FIG. 3, the connector 33 includes an upper connector 34 and lower connector 36. The lower connector 34 of FIG. 3 is a generally annular member shown having a set of slips 38 whose outer radius increases with distance away from the upper end of the upper connector 34. The slips 38 mount on a mandrel 40, that as will be described in more detail below, is selectively movable in an axial direction within the upper connector 34. Collet like ribs 41 are provided on a lower end of the lower connector 36 that in the example of FIG. 3 are raised profiles shown circumscribing the outer surface of the lower end of the lower connector 36. In one example embodiment, the upper connector 34 mounts on an upper end of a lower positioned perforating gun, and the lower connector 36 mounts on a lower end of an upper positioned perforating gun. Such that when the upper perforating gun lands on the lower gun, the surface of the lower connector 36 having the ribs 41 inserts into the upper end of the upper connector 34 and into the annular space between the slips 38 and inner surface of the upper connector 34. The contour of the slips 38 outwardly urges the ribs 41 into engaging contact with the inner wall of the connector 34 as the lower connecter 36 inserts into the upper connector 34; thereby coupling the adjacent perforating guns attached on opposing ends of the connector 33. By axially moving the mandrel 40 in a direction downward, i.e. away from the lower connector 36, the slips 38 move away from the ribs 41 thereby allowing the upper and lower connectors 34, 36 to be disengaged.

FIG. 4 provides in a side partial sectional view one schematic example of perforating within the wellbore 22. A perforating string 42 is shown made up of perforating guns $\mathbf{20}_1$, $\mathbf{20}_2$, . . . $\mathbf{20}_n$ and connectors 33 for coupling each of the adjacent perforating guns. The perforating string 42 may be constructed by landing the guns $\mathbf{20}_1$, $\mathbf{20}_2$, . . . $\mathbf{20}_n$ sequentially in series top to bottom. Attachment between adjacent guns is not limited to the connector of FIG. 3, but can include any type of connection that provides for latching upon landing that may be later selectively released. Components of the gun string 42 are shown in communication via a communication link 44. The communication link 44 includes a main bus 46 from which individual lead buses 48, 50, 52, 54 communicate directly with one of the perforating guns as well as the cablehead 24. Modules provided in each of the perforating guns $\mathbf{20}_1$, $\mathbf{20}_2$, . . . $\mathbf{20}_n$ are equipped with communication devices enabling communication with any of the other guns, the cablehead 24, or the surface via the wireline 26. Moreover, communication may occur through hard links, such as wires that extend along the length of the perforating string 42 as well as wireless links that extend along the wellbore 22. Examples of wireless communication include radio waves, mud pulses, acoustic signals and the like. Further illustrated in the example of FIG. 4 is that the shaped charges 30 within perforating gun $\mathbf{20}_1$ are being detonated to form jets 56 that project radially outward from the perforating string 42 and form perforations 58 into the formation 60 surrounding the wellbore 22. The control modules within the perforating guns enables selective detonation within a single gun and so that a subsequent detonation of a different one or more of the guns in the perforating string 42 can occur while at the same position within the wellbore 22, or at a different depth and at a later time.

Figures 5, 6, 7:
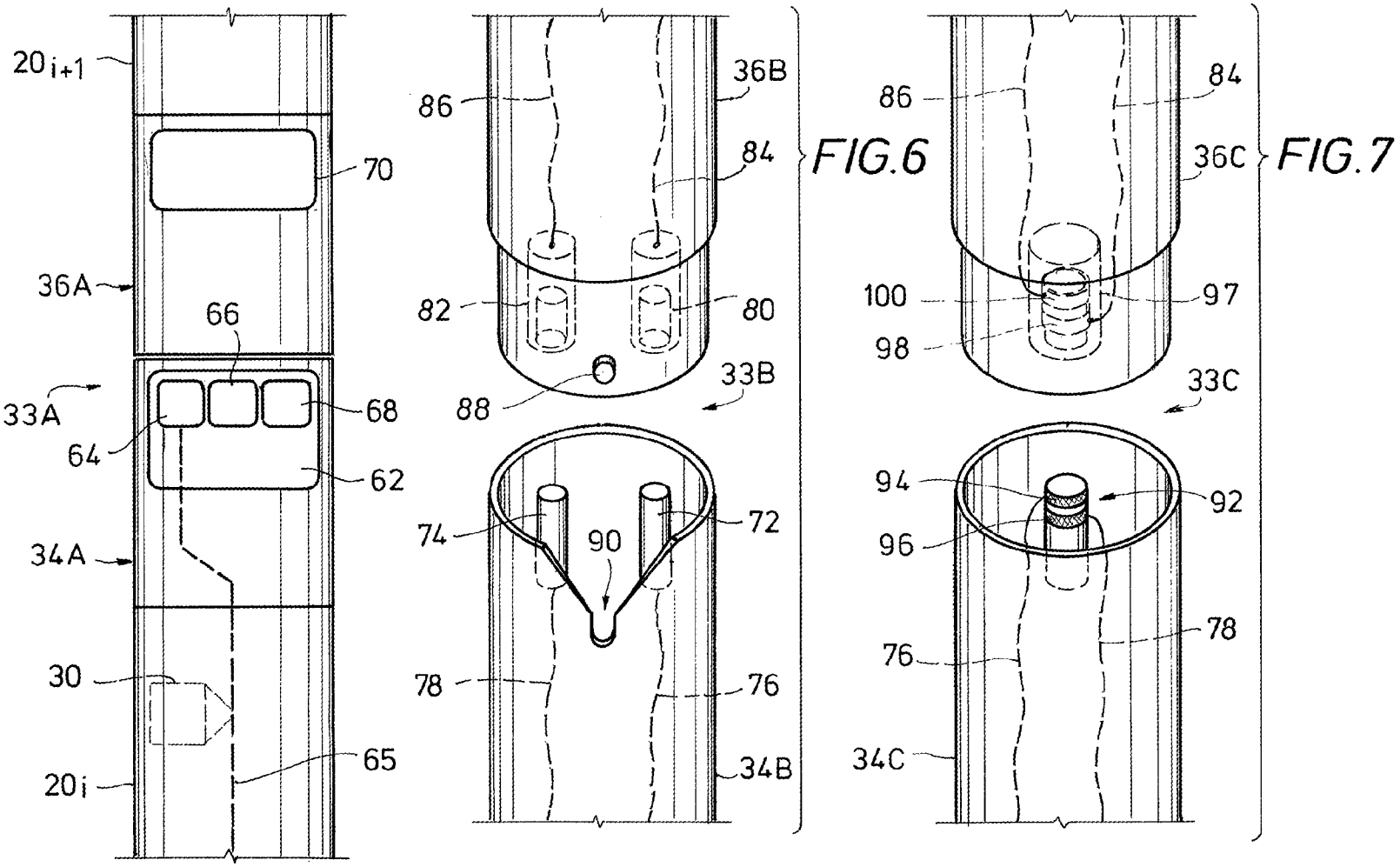
FIGS. 5 through 7 are perspective side sectional views of alternate example embodiments of connectors for perforating guns in accordance with the present invention.

Schematically presented in a side view in FIG. 5 is an alternate example of a connector 33A used to connect adjacent perforating guns $\mathbf{20}_i$, $\mathbf{20}_{i+1}$. An upper connector 34A is shown that includes a firing head 62 that can be used to control detonation of shape charges within the connected perforating gun $\mathbf{20}_i$. In the example of FIG. 5, an initiator 64 is shown for initiating a detonation wave within the perforating cord 65 for detonating charges 30 within the perforating gun $\mathbf{20}_i$. Also illustratively shown within the firing head 62 is a transmitter/receiver 66 that is used for receiving signals within the firing head 62 for controlling operation of the associated perforating gun $\mathbf{20}_i$. The signals may be provided to the transmitter receiver 66 via hardwire (not shown) or wireless signals as discussed above. The use of the term signals herein includes discrete and analog signals that represent or contain information, such as data or commands, as well as an electrical flow of power. A controller 68 is further optionally provided within the firing head 62 for processing signals received from the transmitter receiver 66 and controlling operation of the initiator 64 as well as controlling operation of any data signals that may be transmitted from the transmitter receiver 66. In an optional embodiment, a latching actuator 70 is shown within the lower connector 36A for automating actuation, release, or both of an actuating mechanism (not shown) for coupling together the upper and lower connectors 34A, 36A of the connector 33A. Alternatively, the latching actuator 70 may be provided within the upper connector 34A as well as the lower connector 36A, or instead of being within the lower connector 36A.

FIGS. 6 and 7 provide in perspective view examples of alternate connectors 33B, 33C and that may be useful for a wet connect. For the purposes of discussion herein, a wet connect is a connection formed submerged or in the presence of a fluid, such as wellbore fluid, and when formed provides a pathway for signal travel therethrough. The connector 33B embodiment of FIG. 6 includes a lower connector 34B in which connector pins 72, 74 are provided on an upper end shown projecting towards a lower end of the lower connector 36B. The connector pins 72, 74, which may be formed from a conductive material, are in signal communication with leads 76, 78 shown depending within the upper connector 34B. Examples of the leads 76, 78 include wire, cable, as well as fiber optic material. Receptacles 80, 82 are shown fitted within the lower end of the lower connector 36B and have openings therein shown facing in the direction of the pins 72, 74. Leads 84, 86 are shown provided in the lower connector 36B that connect to and are in electrical and signal communication with the receptacles 80, 82. As such, by inserting the pins 72, 74 into the openings within the receptacles 80, 82 a line of electrical and/or signal communication is created from leads 84, 86 through leads 76, 78. Alignment of the receptacles 80, 82 with the pins 72, 74 may be accomplished via a post 88 shown protruding from an outer surface of the lower connector 36B and a profile 90 that is formed along the inner surface of the upper end of the upper connector 34B. In one example the post 88 lands on the profile 90 and as the lower connector 36 is urged further downward, the post 88 slides to a low point within the profile 90 thereby rotating the lower connector 36B to align the pins 72, 74 with the receptacles 80, 82 for ready insertion therein.

In the embodiment of FIG. 7, the connector 33C includes upper and lower connectors 34C, 36C wherein the upper connector 34C has a single connector pin 92. Contacts 94, 96 are shown provided on the outer circumference of the connector pin 92 that are separated from one another at distinct spaced apart axial locations. The leads 76, 78 connect respectively with the contacts 94, 96 so that electrical and signal communication exists between the contacts, 94, 96 and leads 76, 78. Similarly, a single receptacle 97 is shown set within the lower end of the lower connector 36C and having an opening facing the connector pin 92; thereby when the upper and lower connectors 34C, 36C are substantially coaxially aligned, the connector pin 92 is readily inserted into the receptacle 97. Corresponding contacts 98, 100 are provided within the inner surface of the receptacle 97 that engage the contacts 94, 96 when the pin 92 inserts into the receptacle 97, so that electrical and signal communication extends from the leads 76, 78 and to the leads 84, 86 shown connected to the contacts 98, 100.

As discussed above the perforating string 42 may be dismantled in a manner similar to its construction illustrated in FIGS. 2A through 2C. In an example embodiment of dismantling provided in side partial sectional view in FIG. 8, the string 42 is shown deployed on wireline 26 at a depth relatively proximate to the wellhead housing 28 with the anchor 32A deployed thereby supporting the string 42 within the wellbore 22. The signaling sequence of FIG. 4 may be utilized, i.e. through lines extending through the perforating string 42 or wireless signals, to address each of the connectors 33 within the string 42. Providing a specific address to each of the guns or each specific connector 33 enables selective delatching of the individual perforating guns for retrieval from within the wellbore 22. Stacking and destacking the string 42 proximate the wellhead housing 28 allows for a perforating gun string to have a sufficient number of guns so that wellbore perforating can be accomplished with a single trip into a wellbore; which significantly reduces the time required for multiple trips in and out of a wellbore with shorter gun strings.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of forming a string of perforating guns comprising:

(a) providing a perforating gun having a body, a connector on an upper end and an anchor mounted to the body;

(b) inserting the perforating gun into a wellbore that is surrounded by a formation;

(c) anchoring the perforating gun to a wall of the wellbore by deploying the anchor radially outward and against an inner surface of the wellbore, and which defines a lowermost perforating gun;

(d) inserting upper perforating gun into the wellbore; and (e) landing the upper perforating gun onto the lowermost perforating gun thereby automatically fixedly coupling the upper perforating gun to the lowermost perforating gun thereby forming a string of perforating guns, wherein the step of inserting each perforating gun into the wellbore comprises attaching a wireline to an upper end of each perforating gun and inserting each perforating gun by lowering the wireline into the wellbore.

2. The method of claim 1, further comprising releasing the lowermost perforating gun from the wellbore wall and lowering the string deeper into the wellbore.

3. The method of claim 1, wherein step (c) further comprises inserting a plurality of perforating guns into the wellbore and coupling each adjacent perforating gun.

4. The method of claim 1, wherein the perforating guns are disposed in liquid when coupled to one another the method further comprising providing wet connectors on each of the perforating guns, so that when coupled together the perforating guns are in electrical communication through the wet connectors.

5. The method of claim 1, wherein step (b) comprises deploying the anchor from the perforating gun into contact with the wall of the wellbore.

6. The method of claim 5, further comprising resetting the anchor, decoupling the upper perforating gun from the lowermost perforating gun, and removing the upper perforating gun and the lowermost perforating gun from the wellbore.

7. The method of claim 1, wherein the step of coupling the upper perforating gun to the lowermost perforating gun comprises using a coupler to mechanically attach the upper perforating gun to the lowermost perforating gun, so that when the lowermost perforating gun is unanchored from the wellbore, the upper perforating gun and the lowermost perforating gun can be moved up and down in the wellbore as a single unit.

8. A method of perforating a wellbore comprising:

(a) anchoring a lowermost perforating gun to a wall of the wellbore that is surrounded by a formation by deploying an anchor from the perforating gun against the wall of the wellbore;

(b) forming a perforating string by landing an upper perforating onto the lowermost perforating gun, and automatically fixedly coupling the upper perforating gun to the lowermost perforating gun anchored to the wellbore wall;

(c) releasing the lowermost perforating gun from the wall of the wellbore;

(d) lowering the perforating string to a designated depth within the wellbore; and (e) perforating the wellbore by detonating shaped charges disposed within the perforating string at the designated depth within the wellbore.

9. The method of claim 8, further comprising communicating between the lowermost perforating gun and the upper perforating gun.

10. The method of claim 8, wherein after step (e) some of the shaped charges are not detonated and are in one of the lowermost perforating gun or the upper perforating gun, the method further comprising, moving the perforating string to a depth different from the designated depth of step (e) and detonating the shaped charges that were not detonated in step (e).

11. The method of claim 8, further comprising providing a plurality of additional perforating guns that are coupled together, coupling the additional perforating guns to the upper end of the upper perforating gun, anchoring the perforating string in the wellbore, and selectively decoupling each of the guns.

12. The method of claim 11, further comprising providing a connector for connecting each adjacent gun, wherein each connector is assigned an address, so that by directing a signal to the address each of the guns are selectively decoupled.

13. A perforating system comprising:

a lower perforating gun having a selectively deployable anchoring device;

an upper connector on an upper end of the lower perforating gun;

a contact on an end of the upper connector distal from the lower perforating gun and that is in signal communication with the lower perforating gun;

an upper perforating gun;

a lower connector on a lower end of the upper perforating gun for automatically fixedly connecting to the upper connector when the lower connector lands on the upper connector, further comprising a coupling selectively releasable downhole disposed in at least one of the lower connector or upper connector.

14. The perforating system of claim 13, further comprising a receptacle on an end of the lower connector distal from the upper perforating gun; and an opening in the receptacle in signal communication with the upper perforating gun, so that when the upper and lower perforating guns are coupled the upper and lower connector are mated such that the contact inserts into the opening and the upper and lower perforating guns are in signal communication.

15. The perforating system of claim 13, further comprising a communications module in the upper perforating gun in signal communication with a communications module in the lower perforating gun.

16. The perforating system of claim 15, wherein the signal communication between the communications modules in the upper and lower perforating guns is routed through the connectors.

17. The perforating system of claim 13, wherein the upper and lower connectors comprise a collet and slip assembly for axially affixing the upper perforating gun to the lowermost perforating gun, wherein the slip assembly comprises a frustoconical member that inserts into the collet and wherein the collet has an outer surface circumscribed by rib like profiles.

* * * * *